United States Patent [19]

Shaw

[11] 4,404,550

[45] Sep. 13, 1983

[54] SMOKE DETECTOR - LUGGAGE COMBINATION

[76] Inventor: Jack B. Shaw, 2710 Bedford St., Johnstown, Pa. 15904

[21] Appl. No.: 251,931

[22] Filed: Apr. 7, 1981

[51] Int. Cl.[3] ..... G08B 17/10

[52] U.S. Cl. ..... 340/628; 340/629; 340/630; 340/321; 250/574

[58] Field of Search ..... 340/628, 629, 630, 321; 250/574, 389

[56] References Cited

U.S. PATENT DOCUMENTS 4,186,389 1/1980 Flittie ..... 340/630
4,305,069 12/1981 Machen et al. ..... 340/629
4,319,234 3/1982 Rice ..... 340/628
4,321,591 3/1982 Viewez ..... 340/628

OTHER PUBLICATIONS

"Take Along Smoke Alarm", *Popular Science,* Jan. 1982, p. 39, George L. Beiswinger.

*Primary Examiner*—Gerald L. Brigance
*Attorney, Agent, or Firm*—Fidelman, Wolffe & Waldron

[57] ABSTRACT

A smoke detector is incorporated into hand luggage for the traveler who must occupy high rise structures which may not have effective smoke detection equipment. Alternative power supplies minimize operating costs while insuring operation under all conditions.

9 Claims, 6 Drawing Figures

SMOKE DETECTOR - LUGGAGE COMBINATION

The present invention relates to luggage containing means to detect smoke, and more particularly is directed to personal luggage carrying devices having integrally constructed therewith a smoke detector of the ion or radiation type. Specifically, this invention relates to a smoke detector so mounted and isolated in a piece of luggage as to be continuously or intermittently operable while withstanding the rigors of normal handling techniques.

BACKGROUND OF THE INVENTION

It has been common practice for many years to equip homes with smoke detectors. In recent years various construction codes have been modified to require smoke detectors in both commercial and high and low rise residential and hotels and motels. However, most of the codes do not apply to older structures, while continuous operability of smoke and fire detectors in existing installations is never completely assured due to failure from either improper maintenance procedures or loss of power. The recent spate of fires in high rise hotels delineates the seriousness of the problem. The traveler confronting these factors has in recent times relied solely on the existing alarm systems or the local fire department for rescue from building fire, many having a mental standing rule never to stay above the eighth floor so that the extension ladders of a fire truck can reach the premises occupied.

Generally, when an alarm sounds, the building occupant has ample time to evacuate the premises or take other action to avoid the fire consequences. However, without a foolproof alarm system, such course of action cannot always be utilized. To insure an adequate alarm, many imaginative and complex systems have been proposed, but as previously noted, most builders are reluctant to retrofit older structures with such devices, and maintenance and power, either on-line or back-up, are not always operable.

SUMMARY OF THE INVENTION

This invention is directed to the combination of a piece of hand luggage which integrally incorporates a smoke detecting device, and specifically to such a combination which may be easily transported while providing peace of mind to the high rise, particularly motel or hotel, occupant. To operate the smoke detector of this invention, either the portable (battery type and/or the actual house current of the occupied structure may be relied upon for either full or initial electrical support. The luggage structure is only slightly modified to incorporate the smoke detector and it is contemplated that older pieces of luggage may be modified to include the smoke detecting device proposed. Since a smoke detecting structure is relatively small, the invention may be utilized with luggage varying from briefcase to three-suitors sizes or larger. Similarly, garment bags may be combined with the smoke detector to provide peace of mind to the business traveler who only carries such a bag.

It is therefore an object of the present invention to provide an improved luggage type device which incorporates a smoke detecting device as an integral structural element.

It is a further object to provide such a device which may utilize either house, battery or both power sources.

It is still a further object of this invention to provide a novel combination of luggage and smoke detector which may be either initially manufactured or wherein standard luggage may be modified to incorporate the smoke detector device.

Other objects and a fuller understanding of the invention will be had by referring to the following description and claims to the invention taken in conjunction with the accompanying drawings wherein like reference characters refer to similar parts throughout the several views and in which:

PREFERRED AND ALTERNATE EMBODIMENTS OF THE INVENTION

Although specific terms are used in the following description for the sake of clarity, these terms are intended to refer only to the particular structure of the invention selected for illustration of the drawings, and are not intended to define or limit the scope of the invention.

Figure 1:
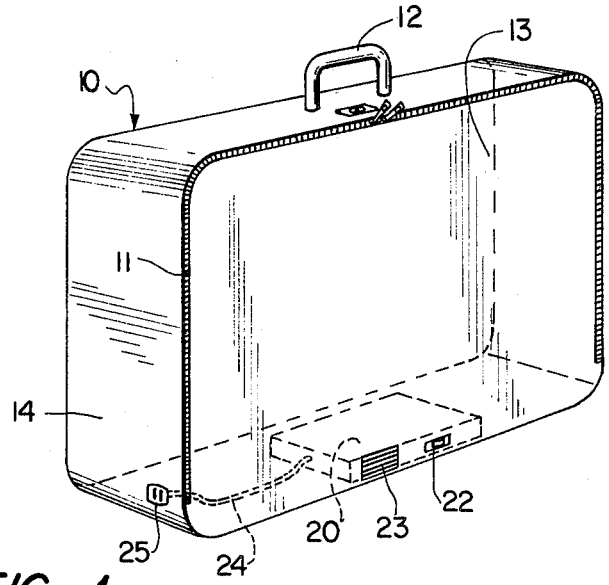
FIG. 1 is a side perspective view, partially in section, of a piece of luggage having a smoke detector integrally constructed therewith.

Referring now to the drawings, FIG. 1 shows a conventional 1–3 suitor or overnight bag (dependent on size) generally designated 10 having a standard zipper fastener 11 and handle 12.

The suitcase 10 includes a top 13 and bottom (not shown) and a side wall 14 which extends around the entire case between the top and bottom. The top and bottom may be made of flexible or rigid materials, while the side walls are generally composed of a metal inner liner 16 (FIG. 3) with cloth or plastic overlays 17 and 18 on both the inner and outer surfaces, respectively of said liner 16.

Figure 3:
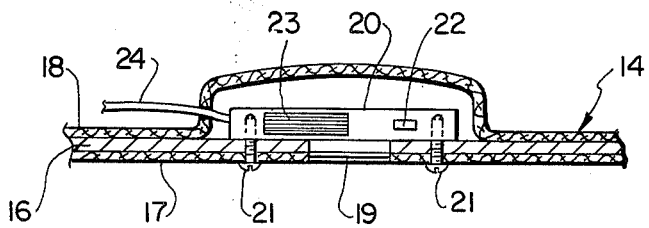
FIG. 3 is a cut-away, expanded view of the area of the luggage containing the smoke detector, showing both the mounting and side panel construction in detail.

The smoke detector 20 of the instant invention is positioned on said side wall 14 by appropriate fastening means 21 which pass through the side wall outer layer 17 and the inner liner 16 into the base of the smoke detector. As shown in FIG. 3, the inner layer 18 covers the upper surface of the smoke detector. The side wall of the case also is provided with a large aperture 19 to communicate the detector element of the smoke detector with the ambient air.

Figure 2:
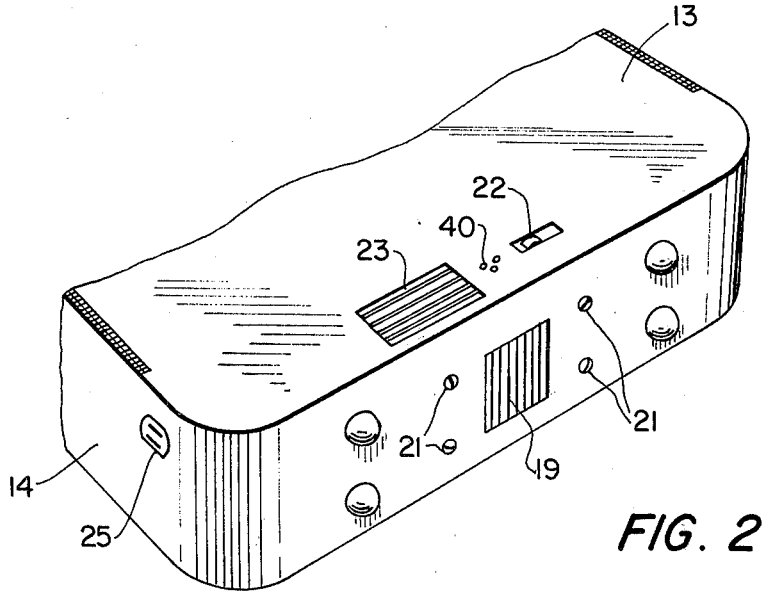
FIG. 2 is a partial bottom side perspective view showing the mounting means and alarm and switch relationship.

Shown in FIGS. 1 and 2, the smoke detector is also adjacent either the top or bottom of the case, which is provided with appropriate apertures for a speaker 23 (horn) output, and an on-off switch 22 for the detector electrical circuit. In additional to the switch and speaker, the smoke detector is connected to a plug 25, said connection being an electric cord 24 which passes through the upper liner 18 and traverses the inner surface of the side wall to said plug. An appropriate double male cord, not shown, would be included with the suitcase to connect the case to a wall outlet for line current.

As previously indicated, the specific structure of the smoke detector forms no part of the instant invention, such being well known to the art.

Figure 4:
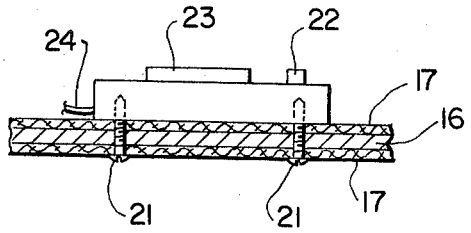
FIG. 4 is an alternative mounting to be used in retrofit for older cases.

The embodiment described above would find principal utility where the smoke detector is incorporated into a suitcase specifically designed therefor. As an alternative, shown in FIG. 4, older cases could be modified by mounting the detector in the suit wall by fasteners 21 and providing the switch and horn as well as the detector element facing the inside of the piece of luggage. In this embodiment, the cord could terminate in a male plug, said cord being of sufficient length to extend to a wall outlet.

Figure 5:
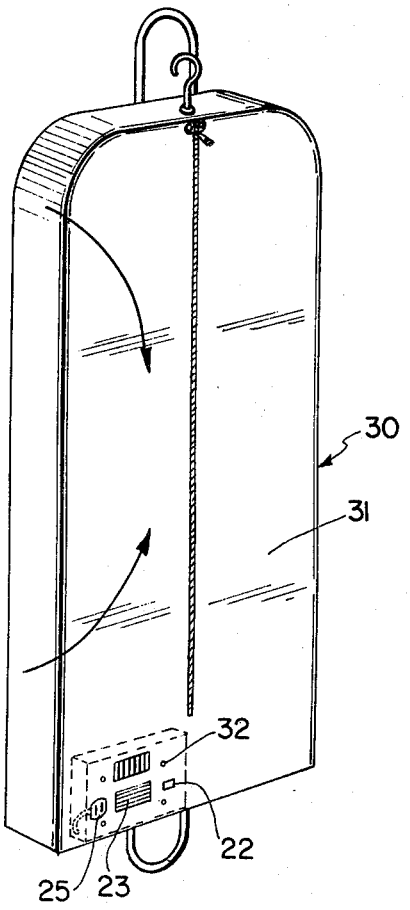
FIG. 5 shows a garment bag modified to incorporate a smoke detector.

This invention also could be used in conjunction with a garment bag, generally designated 30 as shown in FIG. 5. Such bag is generally constructed to be folded inwardly as shown by the arrows and the smoke detector would be mounted on the wall 31 which would be folded inwardly. In this embodiment apertures are provided for the switch 22, the horn 23, the female plug 25 and the access to detector element 19. Suitable fastening means such as rivets 32 may be used to attach the smoke detector to the relatively soft wall 31 of the bag. Alternatively, adhesives may be used not only in this embodiment, but in those of FIGS. 1–4.

Figure 6:
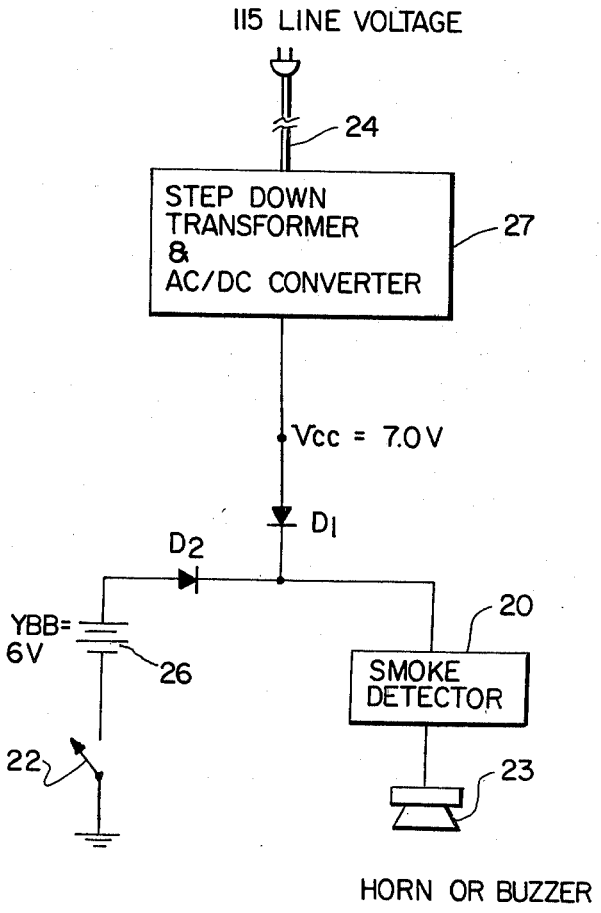
FIG. 6 is a circuit diagram showing the integration of both line power and battery power for the alarm-luggage combination.

The smoke detector 20 is rendered operational by either line voltage or a self-contained battery unit through use of a circuit such as described in FIG. 6. In this circuit, a switch 22 connects a battery 26 through diode $D_2$ to the actual smoke detector maintained in housing 20 while line current from line 24 is conducted through a step-down transformer and AC/DC convertor through diode $D_1$ to the smoke detector 20 housing. The voltage from the lines is converted to 7.0 volts. Through use of diodes $D_1$ and $D_2$ the AC power always drives the device except when AC is lost by line power failures or unavailability. When line power returns, this voltage source is automatically reinstated. Switch 22 is used to inactivate the battery supply when the suitcase is not in use or in transit.

When in use, the bag of FIGS. 1–3 should be positioned either near the hotel room door or on a shelf or counter, making sure the detector aperture is unencumbered. The case of FIG. 4 should be empty with the zipper not fastened and the top 13 opened. With the garment bag of FIG. 5, the bag should be hung in the open position, preferably with the hangers over a door (not in the closet) with the wall 31 facing away from the door.

The specific type of smoke detector is not critical, although it is preferred to use the ionization type due to its simplicity and reliability. The particular construction and method of operation form no part of the invention that are well known to the patent and commercial arts. It is further contemplated that as in U.S. Pat. No. 3,938,115, a temperature responsive fusible element 40 as shown in FIG. 2 may be interposed in the alarm system to automatically operate the alarm of the smoke detector to sense elevated temperatures. In this context, as a complete embodiment of this invention, attention is directed to U.S. Pat. Nos. 3,938,115 and 3,383,670, the disclosures of which are incorporated by reference herein for showings of alarm devices for the instant invention.

Although I have described the present invention with reference to the particular embodiments herein set forth, it is understood that the present disclosure has been made only by way of example, and that numerous changes in the details of construction may be resorted to without departing from the spirit and the scope of the invention. Thus, the scope of the invention should not be limited to the foregoing specification, but rather only by the scope of the claims appended hereto.

I claim:

1. A luggage-type device including a smoke detector, said luggage comprising an upper and lower portion and side portion, said upper portion being hinged to said side portion, with means to join said upper and side portions when said luggage is transported, said side portion including a semi-rigid support portion having supported thereon a smoke detecting device, a vent means communicating said smoke detector to outside said luggage, said vent passing through said side portion of said luggage and power supply means to supply power to said smoke detector.

2. The structure of claim 1 wherein said vent is integral with said semi-rigid side portion.

3. The luggage of claim 1 wherein said power supply includes both battery and access to line current, with integral means to switch to said battery upon failure of said line current.

4. The luggage of claim 3 wherein said smoke detector includes a fusible element for heat actuation.

5. The luggage-type of claim 1 wherein the smoke detector is of the ionization type.

6. The luggage-type device of claim 2 wherein said smoke detector is of the photoelectric type.

7. The luggage of claim 1 wherein said smoke detector is mounted on said rigid support by four isolated fasteners and said vent passes through said side portion in proximity to said smoke detector mountings.

8. A luggage-type device of the garment-hanging type, said luggage device comprising an outer and inner soft wall portion, said inner wall portion including an opening means, said outer and inner wall portions being circumferentially joined by connecting means, said luggage being foldable inwardly whereby when folded said inner wall portion is substantially covered and protected by said outer wall portion, one of said inner and outer wall portions including a semi-rigid support portion having supported thereon a smoke detecting device, a vent means communicating said smoke detector to outside of luggage, said vent passing through said inner or outer wall portion of said luggage and power supply means to supply power to said smoke detector.

9. The luggage of claim 8 wherein the smoke detector is mounted on the bag to face the inside of the bag when said bag is folded.

* * * * *